US010106367B2

(12) United States Patent
Nilsson

(10) Patent No.: US 10,106,367 B2
(45) Date of Patent: Oct. 23, 2018

(54) REINFORCED CABLE SPOOL

(71) Applicant: Axjo Plastic AB, Gislaved (SE)

(72) Inventor: Jacob Nilsson, Anderstorp (SE)

(73) Assignee: AXJO PLASTIC AG, Gislaved (SE)

( * ) Notice: Subject to any disclaimer, the term of this patent is extended or adjusted under 35 U.S.C. 154(b) by 0 days.

(21) Appl. No.: 15/213,905

(22) Filed: Jul. 19, 2016

(65) Prior Publication Data

US 2018/0022571 A1 Jan. 25, 2018

(51) Int. Cl.
*B65H 75/14* (2006.01)
*B65H 54/02* (2006.01)

(52) U.S. Cl.
CPC ..... *B65H 75/14* (2013.01); *B65H 54/02* (2013.01); *B65H 2701/513* (2013.01)

(58) Field of Classification Search
CPC ..... B65H 75/14; B65H 54/02
USPC ..... 242/614.1
See application file for complete search history.

(56) References Cited

U.S. PATENT DOCUMENTS

2002/0125364 A1* 9/2002 Ripplinger ..... B65H 75/14 242/614.1
2003/0197087 A9* 10/2003 Cox ..... B65H 75/14 242/608.6
2008/0217464 A1* 9/2008 Ridgeway ..... B65H 75/14 242/608
2015/0329311 A1* 11/2015 Connell ..... B65H 75/22 242/118.61

* cited by examiner

*Primary Examiner* — Sang K Kim
(74) *Attorney, Agent, or Firm* — Buchanan, Ingersoll & Rooney P.C.

(57) ABSTRACT

A cable spool for use in automated cable winding applications, said cable spool comprising a barrel having an outside diameter and a length, and two annular flanges located at opposite ends of said barrel, wherein each one of said flanges has an inward facing side directed towards said other flange and an outward facing side, each one of said flanges includes at least one through-hole extending between said inward facing side and said outward facing side, wherein each one of said through-holes forms a start hole, and each one of said flanges includes at least one reinforcement portion positioned between said barrel and said through-holes, wherein said at least one reinforcement portion has a height measured in a radial direction from a lateral surface of said barrel to a distal edge of said at least one reinforcement portion.

12 Claims, 2 Drawing Sheets

REINFORCED CABLE SPOOL

FIELD OF THE INVENTION

The invention relates to a cable spool for use in automated cable winding applications, said cable spool comprising a barrel and two annular flanges, each one of said flanges comprising at least one reinforcement portion.

BACKGROUND

Cables, e.g. house wiring cables, are efficiently transported and stored by winding them up on a spool. As cables are relatively heavy, especially when wound up on a spool, the spool has to be strong enough to support the weight of the cable when fully loaded.

As cable spools often are stored and transported in the open air, they also have to tolerate a wide range of ambient temperatures without failing. In practice, the limiting factor of plastic spools is often their cold resistance, as a low ambient temperature can cause the plastic to fracture when stressed. For this reason, cable spools are subjected to a so-called "drop test" to determine their strength at low temperatures. This test is done by cooling a fully wound cable spool to a set temperature, usually −25° C. or lower, then dropping it under a variety of different conditions and checking for damages.

As more and more producers manage to provide cable spools which pass a standard drop test, the buyers of cable spools increase their demands and request spools that can tolerate an even lower temperature than what was previously possible. As such, there is a need for a cable spool which can pass a drop test at lower temperatures than current cable spools can, without being overly expensive or heavy.

SUMMARY OF THE INVENTION

An object of the present invention is therefore to alleviate the abovementioned problems and provide a reinforced cable spool for use in automated cable winding applications.

The above and other objects which will be evident from the following description are achieved by a cable spool for use in automated cable winding applications according to the present invention.

According to one exemplary embodiment, a cable spool for use in automated cable winding applications is provided. The cable spool comprises a barrel having an outside diameter and a length, and two annular flanges located at opposite ends of the barrel. Each one of the flanges has an inward facing side directed towards the other flange and an outward facing side. Each one of the flanges comprises at least one through-hole extending between the inward facing side and the outward facing side. Each one of the through-holes forms a start hole. Each one of the flanges comprises at least one reinforcement portion positioned between the barrel and the through-holes, wherein the at least one reinforcement portion has a height measured in a radial direction from a lateral surface of the barrel to a distal edge of the at least one reinforcement portion.

Having the flanges provided with a reinforcement portion makes the cable spool more rigid and more likely to pass a drop-test as described above. When subjected to a drop-test, presently available cable spools often fail at a corner of the through-hole.

It is to be understood that the through-holes of the flanges extend in a direction substantially perpendicular to the inward facing side and the outward facing side. A start hole is understood by a person skilled in the art as being the hole through which a cable is passed when it is to be wound upon a cable spool. It should also be understood that other holes than the aforementioned at least two through-holes can be provided on the cable spool. For example, the cable spool may comprise holes for securing the cable once the cable spool has been fully wounded. The cable spool may also comprise secondary start holes for use in manual winding applications or holes for driving the rotation of the cable spool when winding a cable around it, either in automatic or manual applications.

According to one exemplary embodiment, the reinforcement portion is provided as a solid flange extending the entire circumference of the barrel.

By providing the reinforcement portion with a solid flange extending the entire circumference of the barrel, the cable spool becomes more rigid and tension is distributed more evenly across the cable spool. There is also less risk of small pieces of the reinforcement portion breaking free if it is made in one piece. Finally, the reinforcement portion being made in one piece also means that the reinforcement portion provides fewer edges on which a cable can be damaged.

According to one exemplary embodiment, the reinforcement portion is provided as a flange extending over part of the circumference of the barrel.

According to one exemplary embodiment, the reinforcement portion is provided as a buttress.

A buttress is to be understood as being a structure providing support between two substantially perpendicular surfaces, such as between the flange and the barrel.

By providing the reinforcement portion as a buttress, the strength and stability of the cable spool is increased.

According to one exemplary embodiment, the reinforcement portion is provided as a single continuous buttress.

This is to be understood as meaning that the buttress extends around the circumference of the barrel. By providing a single continuous buttress, the cable spool becomes more rigid and tension is distributed more evenly across the cable spool. There is also less risk of small pieces of the buttress portion breaking free if it is made in one piece. Finally, the buttress being made in one piece also means that the buttress provides fewer edges on which a cable can be damaged.

According to one exemplary embodiment, the reinforcement portion is provided as a plurality of buttresses.

A plurality of buttresses is to be understood as meaning for example a number of buttresses equidistantly distributed along the circumference of the barrel. By providing the reinforcement portion as a plurality of buttresses, a good balance between strength and weight can be achieved, i.e. a good strength-to-weight ratio is achieved.

According to one exemplary embodiment, the buttresses may extend around the circumference of the barrel.

According to one exemplary embodiment, the height of the at least one reinforcement portion is approximately 5-15% of the outside diameter of the barrel, preferably 8-12%, and most preferably 10%.

Having the reinforcement portion provided such that it has a height of 5-15% of the outside diameter of the barrel allows the cable spool to pass drop-tests at much lower temperatures and/or loads than presently available cable spools can.

The size of and distance between the start holes must be within certain tolerances in order for the cable spool to fit into presently used winding machines. Furthermore, the diameter of the barrel must not be less than a certain dimension, said dimension being determined by the type of cable to be used, in order to not damage the cable. Thus, the height of the at least one reinforcement portion affects where the start holes may be located and what size they may have, so having the reinforcement portion provided such that it has a height of 5-15% of the outside diameter of the barrel allows the cable spool to be fit into presently used winding machines, while at the same time, the risk of damages to the cable is low.

According to one exemplary embodiment, the height of the at least one reinforcement portion is 3-7 mm, preferably 4-6 mm, and most preferably 5 mm.

The abovementioned height of the reinforcement portion provides good stability and rigidity to cable spools having a flange diameter of about 165 mm.

According to one exemplary embodiment, the barrel is further provided with four spokes located between an inner barrel and an outer wall of the barrel.

By providing the barrel with four spokes, the cable spool maintains a round shape during use and as it is produced. Providing the barrel with fewer spokes than three has proven unsuitable for producing cable spools that maintain their round shape after production and during use.

According to one exemplary embodiment, the outside diameter of the barrel is 47-55 mm, preferably 48-50 mm, and most preferably 48.6 mm.

The diameter of the barrel must not be less than a certain dimension, said dimension being determined by the type of cable to be used, in order to not damage the cable. The abovementioned dimensions provide a good balance between usability and capacity for storing cables.

According to one exemplary embodiment, the cable spool is made of PE or PP having a density of 0.8-1.2 kg/m$^3$.

Having the cable spool made of PE or PP having the abovementioned density provides a good balance between strength, weight and price. Thus, a cable spool can be created which can pass a drop test at lower temperatures than current cable spools can, without being overly expensive or heavy.

According to one exemplary embodiment, the cable spool is made of PE or PP having a density of 0.92-0.98 kg/m$^3$.

Having the cable spool made of PE or PP having the abovementioned density provides an even better balance between strength, weight and price. Thus, a cable spool can be created which can pass a drop test at lower temperatures than current cable spools can, without being overly expensive or heavy.

According to one exemplary embodiment, the outward facing side of each one of the flanges is provided with a honeycomb shaped pattern of reinforcement ribs.

By providing the flanges with a honeycomb shaped pattern of reinforcement ribs, the rigidity of the flanges can be improved without significantly increasing the weight of the cable spool.

According to one exemplary embodiment, the outward facing side of each one of the flanges is provided with a diamond shaped, or triangularly shaped patter of reinforcement ribs. It should be understood that the pattern of reinforcement ribs can have other geometric shapes as well.

According to one exemplary embodiment, the honeycomb shaped pattern of reinforcement ribs is radially aligned around a longitudinal axis of the barrel.

By radially aligning the pattern of reinforcement ribs, an even reinforcement of the flanges is achieved. A radially aligned pattern is to be understood as meaning a pattern that is centered about a center point, in this case the longitudinal axis of the barrel, and repeated in an angular direction. An example of another radially aligned pattern is a starburst pattern.

According to one exemplary embodiment, the honeycomb shaped pattern of reinforcement ribs comprises reinforcement ribs having a draft angle of more than 1 degree.

Providing the pattern of reinforcement ribs with a draft angle allows for better material efficiency. Thus, a lower weight-to-strength ratio can be achieved. Furthermore, a draft angle allows for easier manufacturing as the finished product becomes easier to remove from the mold.

According to one exemplary embodiment, an outward facing side of the at least one reinforcement portion is provided with a plurality of ribs extending in a radial direction.

By providing the reinforcement portion with ribs, a sufficient strength can be achieved without having to increase the weight of the cable spool so that it becomes unnecessarily heavy. In other words, a lower weight-to-strength ratio can be achieved. This reduces material costs and the environmental impact of the cable spool.

According to one exemplary embodiment, the at least one reinforcement portion is an annular reinforcement portion.

The reinforcement portion being an annular reinforcement portion should be understood as meaning that the reinforcement portion extends substantially the entire circumference of the barrel.

According to one exemplary embodiment, the at least one reinforcement portion is provided at the portions of the flanges which are located between the through-holes and the barrel.

According to one exemplary embodiment, the inward facing side of the flanges is substantially smooth.

By providing the inwards facing side of the flanges with a substantially smooth surface, the amount of wear on the cable can be significantly reduced.

In this context, significantly smooth is to be understood as meaning that the part of the inward facing side of the flange which is not provided with a hole of any kind should not be provided with any other features such as reinforcement ribs or similar structural elements.

According to one exemplary embodiment, each one of the through-holes is shaped as a rectangle with rounded corners.

By having the through-holes provided with rounded corners, the amount of friction the cable experiences is lowered, thus lowering the amount of cable wear.

According to one exemplary embodiment, the radius of the rounded corners is at least 5 mm.

By having a rounded corner having a radius of at least 5 mm, it is ensured that the radius is equal to or larger than the radius of the cable which is to be spooled on said cable spool. Thus, the amount of cable wear is reduced.

According to one exemplary embodiment, each one of the through-holes has three straight edges and one concave edge, and the concave edge has a curvature arranged to follow the curvature of the at least one reinforcement portion.

By providing the through-hole with a concave edge, the through-hole can be positioned much closer to the barrel than what would otherwise have been possible. Thus, the cable spool can hold more cable than what would otherwise have been possible.

According to one exemplary embodiment, the concave edge has a curvature arranged to follow the curvature of the at least one reinforcement portion and the at least one reinforcement portion has a curvature arranged to follow the curvature of the barrel.

According to one exemplary embodiment, the through-hole has one edge on the inward facing side of the flanges which is provided with a radius of more than 0.1 mm.

This radius is to be understood as being provided on the edge separating the inward facing side of a flange from the lateral surface of a through-hole located on this flange.

According to one exemplary embodiment, the through-hole has three edges on the inward facing side of said flanges being provided with a radius of more than 0.1 mm.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The above, as well as additional objects, features and advantages of the present invention, will be better understood through the following illustrative and non-limiting detailed description of exemplary embodiments of the present invention, with reference to the appended drawing, wherein.

DETAILED DESCRIPTION OF THE DRAWINGS

In the present detailed description, embodiments of a cable spool according to the present invention are mainly discussed with reference to a drawing showing a cable spool with components and portions being relevant in relation to various embodiments of the invention. It should be noted that this by no means limits the scope of the invention, which is also applicable in other circumstances for instance with other types or variants of cable spools than the embodiments shown in the appended drawings. Further, that specific features are mentioned in connection to an embodiment of the invention does not mean that those components cannot be used to an advantage together with other embodiments of the invention.

The invention will now by way of example be described in more detail by means of embodiments and with reference to the accompanying drawings.

Figure 1:
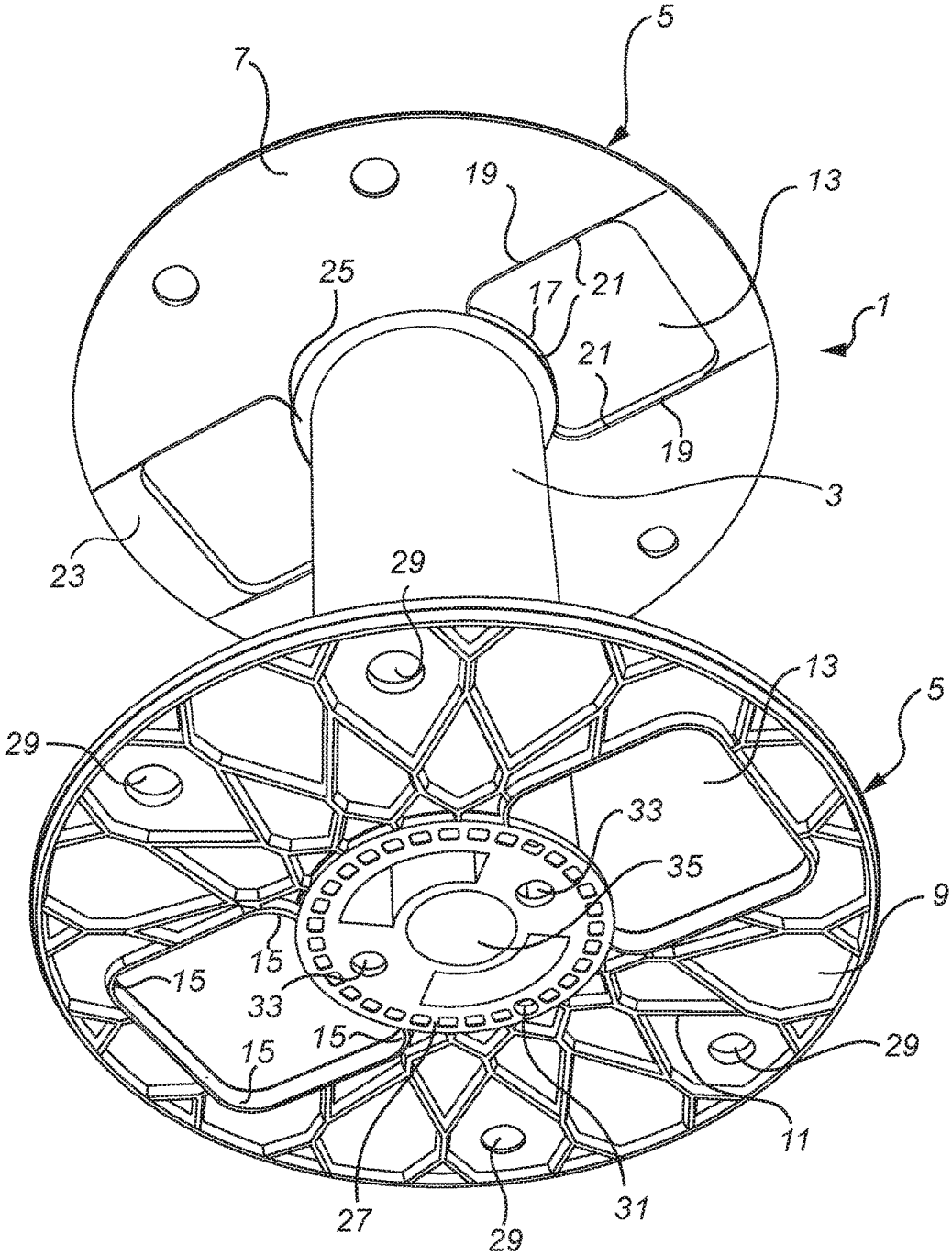
FIG. 1 is a perspective view of a cable spool according to the present invention.

FIG. 1 is a perspective view of a cable spool 1 comprising a barrel 3 and two annular flanges 5. The cable spool 1 is arranged to be able to hold a cable that has been wound onto the cable spool 1, either by an automated or a manual cable winding machine.

Each one of the two flanges 5 has an inward facing side 7 directed towards the other flange 5 and an outward facing side 9 directed away from the other flange 5. The inward facing sides 7 of the two flanges 5 are substantially smooth, so as to not damage the cable that is to be wound around the barrel 3 and supported by the inward facing sides 7 of the two flanges 5. Each one of the outward facing sides 9 of the two flanges 5 is provided with a radially aligned, honeycomb shaped pattern of ribs 11, which strengthens the flanges 5 so that they are less likely to fail when the cable spool 1 is fully wound.

On each one of the two flanges 5, there is provided two symmetrically distributed through-holes 13 for receiving a cable to be wound around the barrel 3, also known as start holes. The start holes 13 extend from an inward facing side 7 to an outward facing side 9 of the flanges 5. When a cable is to be wound onto the cable spool 1, the cable is passed through the start hole 13 from the inward facing side 7 to the outward facing side 9, where it is then held in place as the cable spool 1 is rotated, thus causing the cable to be winded onto the cable spool 1. The start holes 13 are shaped as rectangles with rounded corners 15, each one having one edge having a concave curvature 17 and the other three edges being straight 19. The edge having a concave curvature 17 is the edge which is located closest to the barrel 3. The start holes 13 are 40 mm by 50 mm, with the longest side being the side that has one straight 19 and one concave edge 17. The large size of the start holes 13 in relation to the diameter of the cable that is to be wound upon the cable spool 1 is due to the fact that the automated winding machines come in certain standard sizes and that this needs to be taken into consideration when designing the cable spool 1. The curvature of the concave edge 17 of the start hole 13 is such that it follows the curvature of the barrel 3. The edge having a concave curvature 17 and the two edges neighboring this edge are each provided with a radius 21 of around 0.25 mm on the inward facing side 7 of the flange 5. Thus, these edges are less likely to damage the cable that is to be wound around the cable spool 1. The edge 19 which is diametrically opposed the edge having a concave curvature 17 is provided with a tapering 23.

Each one of the two flanges 5 further comprises an annular reinforcement portion 25 positioned between the barrel 3 and the concave edge 17 of the start holes 13.

On the outward facing sides 9 of the two flanges 5, the reinforcement portion 25 is provided with a plurality of ribs 27 extending in a radial direction. Each one of the ribs 27 is around 6 mm long and 2 mm wide. Thus, the stability and strength of the cable spool 1 is increased further. On the inward facing side 7 of the two flanges 5, the reinforcement portion 25 is substantially smooth, so as to not damage the cable that is to be wound around the barrel 3 and supported by the inward facing sides 7 of the two flanges 5.

Each one of the flanges 5 of the cable spool 1 also comprises additional, distally located holes 29 having a diameter of approximately 8 mm for securing the cable once the cable spool 1 has been fully wounded. Each one of the flanges 5 also comprises a smaller, secondary start hole 31 extending from the outward facing side 9 to the inward facing side 7 of the flanges 5. This secondary start hole 31 is located next to the barrel 3 and goes right through the annular reinforcement portion 25. The size of this secondary start hole 31 makes it unsuitable for use in automated winding application and it is therefore only used when manually winding the cable spool 1.

The barrel 3 further comprises two diametrically opposed holes 33 located at one end of the barrel and a central through-hole 35 extending through the entire length of the barrel 3. The two diametrically opposed holes 33 are used for driving the rotation of the cable spool 1 when it is used in an automated cable winding application while the central through-hole 35 is used for supporting the cable spool 1.

Figure 2:
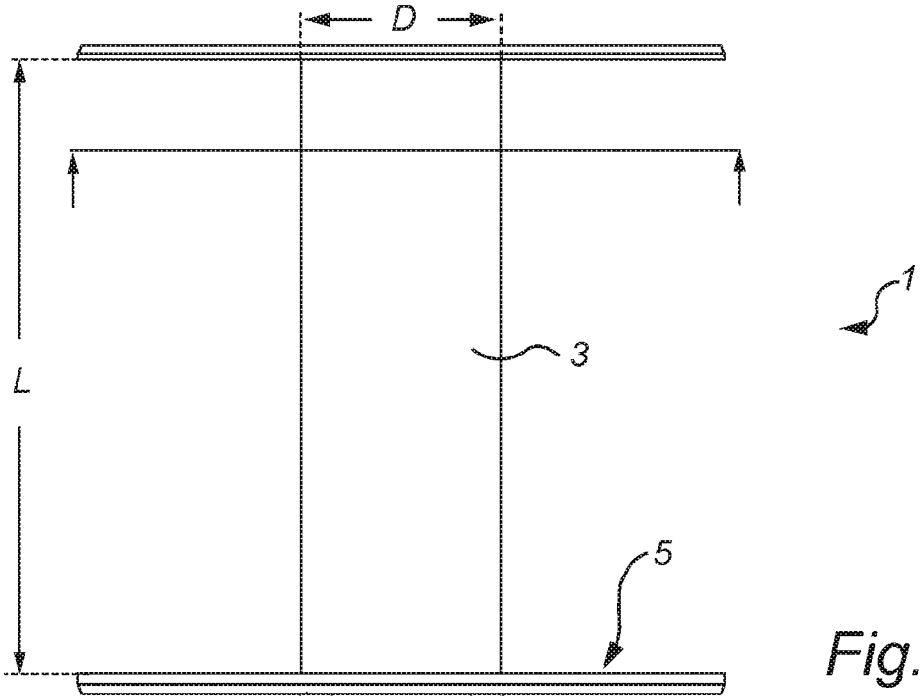
FIG. 2 is a side view of a cable spool according to the present invention.

FIG. 2 is a side view of the cable spool 1, showing an outside diameter and a length of the barrel 3, the outside diameter being sufficiently large so that the cable is not damaged when it is rapidly wound onto the barrel 3. The surface of the barrel 3 is substantially smooth, so as to not damage the cable that is to be wound around it.

Figure 3:
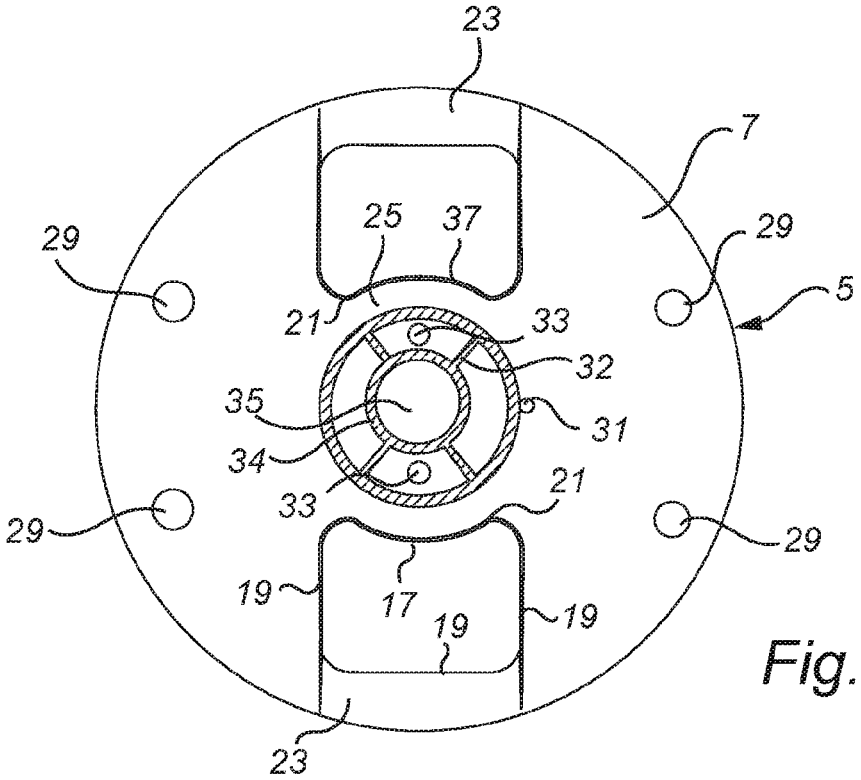
FIG. 3 is a cross-sectional view showing the inward facing side of a flange of a cable spool according to the present invention.

FIG. 3 is a cross-sectional view of the cable spool 1 showing the inward facing side 7 of a flange 5. The reinforcement portion 25 has a height of around 5 mm, measured in a radial direction from a lateral surface of the barrel 3 to a distal edge 37 of the reinforcement portion 25, i.e. around 3% of the flange diameter or around 10% of the outside diameter of the barrel 3. The distal edge 37 of the reinforcement portion 25 coincides, over at least part of the reinforcement portion 25, with the concave edge 17 of the start hole 13. The barrel 3 is further provided with four spokes 32 located between an inner barrel 34 and the outer wall of the barrel 3 for ensuring that the cable spool maintains a round shape during use and as it is produced.

Although exemplary embodiments of the present invention have been described herein, it should be apparent to those having ordinary skill in the art that a number of changes, modifications or alterations to the invention as described herein may be made. Thus, the above description of the various embodiments of the present invention and the accompanying drawings are to be regarded as non-limiting examples of the invention and the scope of protection is defined by the appended claims.

For example, the cable spool 1 can be provided with more than two start holes 13, e.g. three or four start holes 13. The flanges 5 could also be provided with more than one reinforcement portion 25. The cable spool 1 can also be provided with more holes than the start holes 13, the secondary start hole 31, the central through-hole 35 and the two diametrically opposed holes 33 described herein.

Furthermore, any reference signs in the claims should not be construed as limiting the scope.

The invention claimed is:

1. A cable spool for use in automated cable winding applications, said cable spool comprising:

a barrel having an outside diameter and a length, and two annular flanges located at opposite ends of said barrel, wherein each one of said flanges has an inward facing side directed towards said other flange and an outward facing side, each one of said flanges comprises at least one through-hole extending between said inward facing side and said outward facing side, wherein each one of said through-holes forms a start hole, and each one of said flanges comprises at least one reinforcement portion positioned between said barrel and said through-holes, wherein said at least one reinforcement portion has a height measured in a radial direction from a lateral surface of said barrel to a distal edge of said at least one reinforcement portion wherein said at least one reinforcement portion is an annular reinforcement portion.

2. The cable spool according to claim 1, wherein the height of said at least one reinforcement portion is approximately 5-15% of the outside diameter of said barrel.

3. The cable spool according to claim 1, wherein the height of said at least one reinforcement portion is 3-7 mm.

4. The cable spool according to claim 1, wherein the outside diameter of said barrel is 47-55 mm.

5. The cable spool according to claim 1, wherein said cable spool is made of PE or PP having a density of 0.8-1.2 $kg/m^3$.

6. The cable spool according to claim 1, wherein said outward facing side of each one of said flanges is provided with a honeycomb shaped pattern of reinforcement ribs.

7. The cable spool according to claim 6, wherein said honeycomb shaped pattern of reinforcement ribs is radially aligned around a longitudinal axis of said barrel.

8. The cable spool according to claim 7, wherein said honeycomb shaped pattern of reinforcement ribs comprises reinforcement ribs having a draft angle of more than 1 degree.

9. The cable spool according to claim 1, wherein an outward facing side of said at least one reinforcement portion is provided with a plurality of ribs extending in a radial direction.

10. The cable spool according to claim 1, wherein said inward facing side of said flanges is substantially smooth.

11. The cable spool according to claim 1, wherein each one of said through-holes is shaped as a rectangle with rounded corners.

12. The cable spool according to claim 11, wherein each one of said through-holes has three straight edges and one concave edge, and said concave edge has a curvature.

* * * * *